United States Patent [19]

Grattapaglia et al.

[11] 4,162,615

[45] Jul. 31, 1979

[54] HYDRAULIC FLUID TANK PRESSURIZATION DEVICE

[75] Inventors: Giorgio Grattapaglia; Carlo Cecchi, both of Torino, Italy

[73] Assignee: Fiat-Allis Macchine Movimento Terra S.p.A., Lecce, Italy

[21] Appl. No.: 809,154

[22] Filed: Jun. 23, 1977

[30] Foreign Application Priority Data

Jul. 28, 1976 [IT] Italy ..... 68885 A/76

[51] Int. Cl.[2] ..... F04B 49/08; F15B 1/06

[52] U.S. Cl. ..... 60/478; 60/415; 417/307

[58] Field of Search ..... 60/478, 415; 417/307, 417/534

[56] References Cited

U.S. PATENT DOCUMENTS

| | | | |
|---|---|---|---|
| 1,791,364 | 2/1931 | Lewis | 417/534 |
| 2,141,703 | 12/1938 | Bays | 60/415 |
| 2,575,308 | 11/1951 | White | 60/415 |
| 3,039,823 | 6/1962 | Eaton | 298/22 R |
| 3,130,548 | 4/1964 | Hunt | 60/478 |
| 3,398,551 | 8/1968 | Yannascoli | 417/307 X |
| 3,415,053 | 12/1968 | Omon | 60/415 X |
| 3,846,983 | 11/1974 | Freedy et al. | 60/478 |

*Primary Examiner*—Irwin C. Cohen
*Attorney, Agent, or Firm*—August E. Roehrig, Jr.; Robert A. Brown; Harvey W. Rockwell

[57] ABSTRACT

An air pressurizing system including a double acting pneumatic cylinder operatively connected to hydraulic actuated equipment for operation thereby in response to movement thereof to pressurize a hydraulic fluid tank or reservoir and control the air pressure coupled into the hydraulic fluid tank.

4 Claims, 2 Drawing Figures

HYDRAULIC FLUID TANK PRESSURIZATION DEVICE

BACKGROUND OF THE INVENTION

This invention relates in general to systems for pressurizing tanks containing hydraulic fluid used to actuate hydraulic equipment and, in particular, to have a system for pressurizing the varying air space created in a tank containing hydraulic fluid used to operate auxiliary hydraulic actuators when quantities of hydraulic fluid are removed from and returned to the tank or reservoir.

More specifically, but without restriction to the particular use which is shown and described, this invention relates to a vehicle hydraulic fluid tank pressurization system actuated by and during operation of the hydraulic equipment independent of direct coupling to a source of air pressurized by the vehicle engine.

In the operation of vehicles having auxiliary hydraulic operated equipment operated by the selective coupling of a source of pressurized hydraulic fluid to the equipment, pressure fluctuations frequently occur in the fluid reservoirs of such systems during operation of the equipment. Such auxiliary equipment as hydraulic jacks frequently cause extensive changes in the volume of the hydraulic fluid retained in the tank due to the greater volume of fluid required when the jacks are extended than when retracted. These pressure variations frequently cause the hydraulic pump employed in these systems to draw the hydraulic fluid from the reservoir against a vacuum during periods of high fluid demand by the hydraulically operated equipment. This withdrawing of the hydraulic pump against a vacuum causes cavitation of the hydraulic fluid in the pump creating unnecessary and undesirable noise and an excessive amount of wear on various pump components.

In earth-moving vehicles or construction machines, due to the environmental conditions in which such equipment frequently operates, it is necessary that the hydraulic system be closed to prevent the hydraulic fluid from becoming contaminated by the dust, dirt, or other contaminants encountered by the vehicle during operation. Therefore, the source of pressurized air required to prevent pump cavitation must be filtered before being introduced into the hydraulic fluid tank.

In the past various methods have been utilized for maintaining a tank pressure at or slightly above atmospheric pressure. U.S. Pat. No. 3,130,548 discloses a system for pressurizing a hydraulic fluid tank which utilizes a single acting piston cylinder assembly which during extension of the piston rod pressurizes the hydraulic fluid tank. U.S. Pat. Nos. 3,039,823 and 3,846,983 disclose, respectively, systems for pressurizing the air space within a hydraulic fluid containing tank by means of pressurized air either from a compressor driven directly from the vehicle engine or from the engine turbo charger coupled in fluid communication with the hydraulic sump.

As is well known to those skilled in the art, if pressure within the air space is permitted to accumulate or increase to an excessive amount, it is possible that the sump tank will burst. Therefore, it is necessary to not only pressurize the sump tank, but to provide suitable pressure relief means to relieve excessive pressure in the fluid space. In all these prior art systems, the sump tank for containing the hydraulic fluid is equipped with a relief valve to release pressurized air from the air space when the pressure exceeds a predetermined maximum.

The present invention can be utilized to pressurize the air space within the hydraulic fluid tank on a vehicle which does not have a forced air intake and may be utilized without direct coupling to the engine air supply. In addition, the present invention does not require a pressure relief valve to be installed in the hydraulic fluid reservoir or tank but controls delivery of the pressurized air in response to the tank air pressure.

SUMMARY OF THE INVENTION

It is, therefore, an object of this invention to pressurize hydraulic fluid containing tanks associated with hydraulic actuators.

Another object of this invention is to control the pressure level of the air supply coupled to the hydraulic fluid containing tank.

A further object of this invention is to couple a source of pressurized air to the hydraulic fluid containing tank independent from the operating vehicle engine.

Still another object of this invention is to control the introduction of pressurized air into the hydraulic fluid reservoir in direct response to the operation of the hydraulically actuated equipment.

These and other objects are attained in accordance with the present invention wherein there is provided a double acting pneumatic cylinder operatively connected to hydraulic actuated equipment for operation thereby in response to movement thereof to pressurize the hydraulic fluid reservoir and control the level of the air pressure coupled into the hydraulic fluid tank.

DESCRIPTION OF THE DRAWINGS

Further objects of the invention together with additional features contributing thereto and advantages accruing therefrom will be apparent from the following description of a preferred embodiment of the invention which is shown in the accompanying drawings with like reference numerals indicating corresponding parts throughout wherein.

DESCRIPTION OF THE PREFERRED EMBODIMENT

Figure 1:
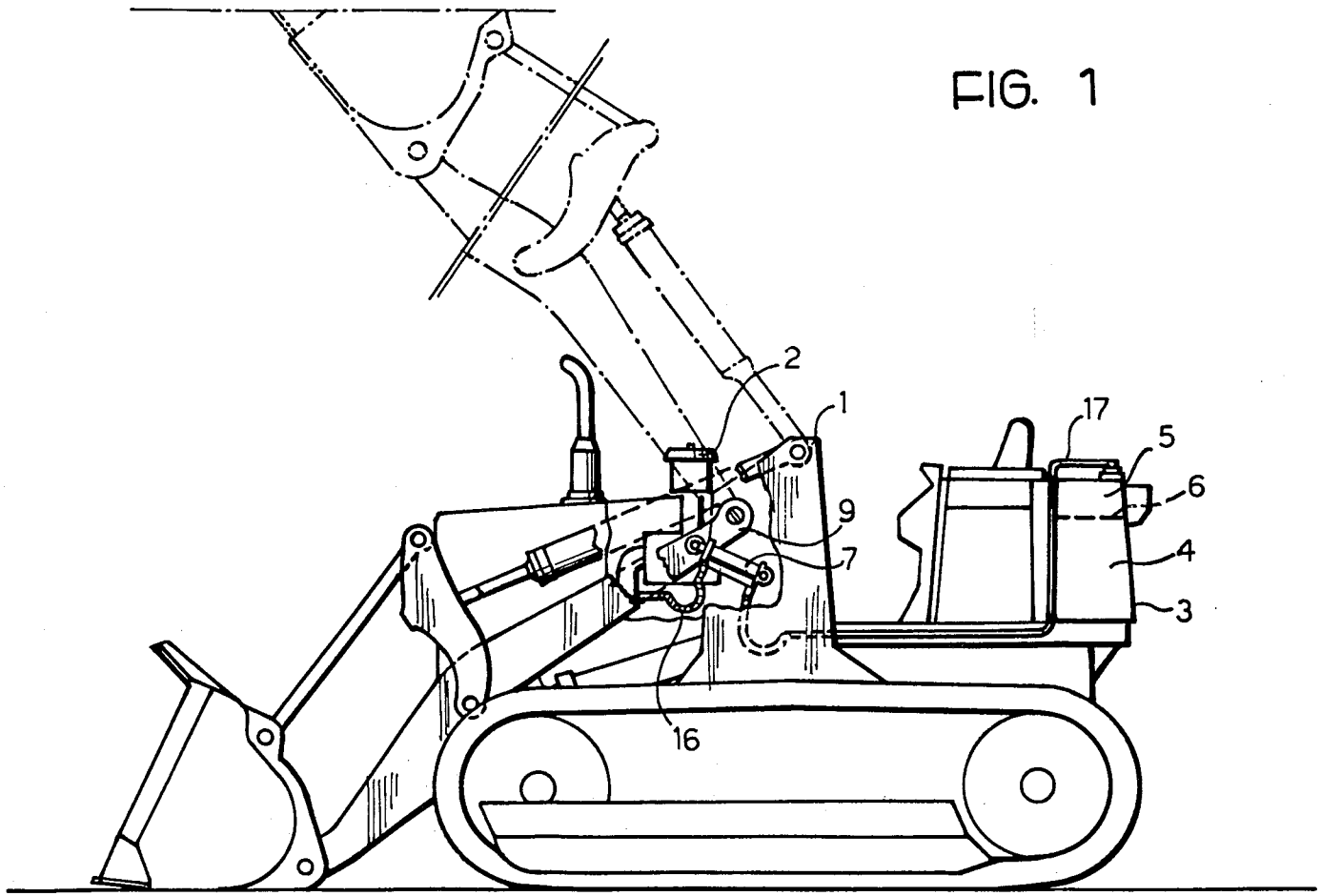
FIG. 1 is a side view of an earth-moving vehicle having a closed hydraulic system and a hydraulic fluid tank pressurization system according to the present invention.

Referring now to FIG. 1, there is shown an earth-moving vehicle 1 having a closed hydraulic system including an engine air filter 2 and a hydraulic fluid tank 3. The tank 3 contains a hydraulic fluid 4 and has an air space 5 above the level 6 of the hydraulic fluid contained within the tank.

The air space 5, above the level 6 of the hydraulic fluid contained within the hydraulic fluid tank 3, is maintained pressurized through a pneumatic cylinder 7 having a reciprocal piston rod 8 carried within. The free end of the piston rod 8 is connected to a hydraulically actuated movable equipment arm 9 of the vehicle 1 such that raising and lowering of the equipment arm 9 reciprocates the piston rod 8 within a cylinder chamber.

Figure 2:
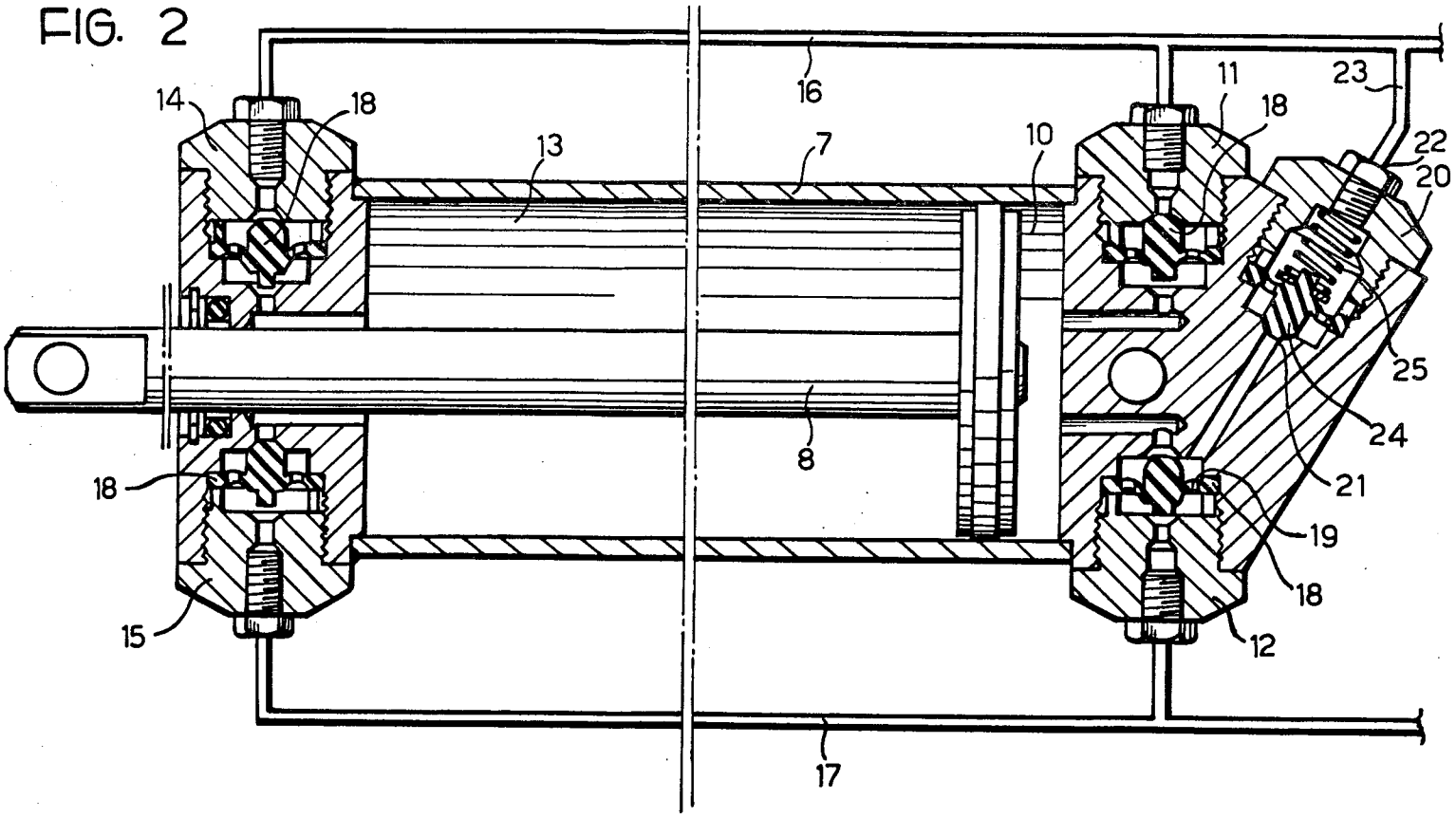
FIG. 2 is a cross-sectional view of a pneumatic cylinder utilized to pressurize the hydraulic fluid tank and control the amount of pressure coupled thereto.

As shown in FIG. 2, the area of the cylinder chamber is divided into two portions 10 and 13. The chamber 10 of the pneumatic cylinder 7 is provided with an associated inlet valve 11 and an associated outlet valve 12 at one end. An inlet valve 14 and an outlet valve 15 are carried at one end of the cylinder chamber associated with chamber 13. Since the environment in which earth-moving vehicles are operated is usually very dusty, the air which is to be pressurized by movement of the reciprocable piston rod 8 must first be filtered to prevent dust and dirt particles from entering the hydraulic fluid. To this end, an air inlet conduit 16 is in fluid communication with valves 11 and 14 through the engine air filters 2 of the earth-moving vehicle. Air, pressurized by the movement of the piston within the cylinder 7, is passed through the outlet valves 12 and 15 to the air space 5 of the hydraulic fluid tank by means of a discharge conduit 17.

Each of the valves 11, 12, 14 and 15 is provided with a blunt taper needle valve 18 suspended on a resilient annular diaphragm perforated by apertures 19 for pressure relief to effect valve movement. The taper portion 18 is suspended for movement along the longitudinal axis of each valve to engage and disengage the valve seat associated therewith.

In order to control the amount of air pressure within the space 5 of the hydraulic fluid tank 3, a pressure relief valve 20 is provided in the pneumatic cylinder 7. The pressure relief valve 20 is connected at its inlet end 21 with the outlet valve 12 and, through the orifices 19 associated with outlet valve 12, to the discharge conduit 17. An outlet end 22 of the pressure relief valve 20 is in fluid communication with the inlet conduit 16 by means of a bypass conduit 23. As with the inlet and outlet valves 11, 12, 14 and 15, the pressure relief valve 20 also has a blunt taper needle valve 24 which is suspended on a resilient annular diaphragm having perforations 19 formed therein and movable along the longitudinal axis of the valve. The pressure relief valve 20 is held in a normally closed position against its associated valve seat by means of a compression spring 25 biasing the valve 24 closed against the valve seat.

In operation, upon raising the vehicle equipment arm 9 the piston rod 8 (shown in its retracted position in FIG. 2) is extended compressing the air within chamber 13. Compression of the air within chamber 13 causes the inlet valve 14 to close and the outlet valve 15 to open by movement of their respective blunt taper needle valve portions 18 into and out from their respective valve seats. The air within chamber 13 is exhausted through the outlet valve 15 and the discharge conduit 17 into the air space 5 of the hydraulic tank 3. The outlet valve 12 associated with chamber 10 is closed by the increased air pressure in discharge conduit 17 acting against the diaphragm and air drawn from the air filter 2 through intake conduit 16 causes the inlet valve 11 to open passing air into chamber 10.

When the vehicle equipment arm 9 is lowered, the piston rod 8 retracts compressing the air within chamber 10 and in the fully retracted position is illustrated in FIG. 2. The outlet valve 12 is opened and inlet valve 11 is closed under the increased air pressure to discharge the pressurized air into discharge conduit 17. The outlet valve 15 has also been caused to close under the increased pressure in discharge conduit 17 and air drawn from the filter 2 through the inlet conduit 16 causes inlet valve 14 to open up allowing air to enter chamber 13.

When a predetermined air pressure exists within the air space 5 of the hydraulic fluid tank 3, the pressurized air is circulated from one of the chambers 10 or 13 into the other of the chambers depending upon whether the piston 8 is in an extension or retraction stroke.

If the predetermined air pressure is reached during a retraction stroke of the piston 8, pressurized air exhausted from the chamber 10 through the outlet valve 12 builds up a pressure at the inlet of the pressure relief valve 20 sufficient to overcome the biasing load of the spring 25. The pressure relief valve 20 is thereby opened and exhausts the pressurized air through conduit 23 into inlet conduit 16. Since the inlet valve 11 is closed, the air passes by inlet conduit 16 through the inlet valve 14 into the chamber 13 thus terminating the supply of pressurized air to the air space 5 of the hydraulic fluid tank 3.

When the predetermined pressure has been reached during the extension stroke of the piston 8, pressurized air expelled from the chamber 13 through outlet valve 15 to discharge conduit 17 flows through the orifices 19 of the outlet valve 12. The outlet valve 12, however, has been closed by the increased pressure in discharge line 17. Therefore, the increase in the pressure at the inlet end of the pressure relief valve 20 causes the blunt taper needle valve 24 to be moved from its associated valve seat exhausting the pressurized air through conduit 23 into conduit inlet 16. Since inlet valve 14 is being held closed due to the movement of the piston 8, inlet valve 11 will open causing the pressurized air to flow into chamber 10 thereby terminating the source of pressurized air to the air space 5 of the hydraulic fluid reservoir 3.

While the invention has been described with reference to a preferred embodiment it will be understood by those skilled in the art that various changes may be made and equivalents may be substituted for elements thereof without departing from the scope of the invention. In addition many modifications may be made to adapt a particular situation or material to the teachings of the invention without departing from the essential scope thereof. Therefore, it is intended that the invention not be limited to the particular embodiment described as the best mode contemplated for carrying out this invention, but that the invention will include all embodiments falling within the scope of the appended claims.

What is claimed is:

1. An air pressurizing system for pressurizing an air space in a reservoir containing hydraulic fluid which varies in quantity in response to movement of hydraulically actuated equipment coupled in fluid communication therewith comprising a pneumatic cylinder having a reciprocable piston and piston rod movable within a chamber for compressing air within said chamber, the piston rod of said pneumatic cylinder operatively connected by mechanical means to hydraulically actuated equipment for movement of said reciprocal piston in response to movement of the hydraulically actuated equipment mechanically connected thereto, air inlet valve means in fluid communication with said pneumatic cylinder chamber for passing air thereinto in response to reciprocal movement of said piston rod, air outlet valve means in fluid communication with said pneumatic cylinder chamber for passing compressed air therefrom in response to reciprocal movement of said piston rod, reservoir means for containing hydraulic fluid which varies in quantity in response to movement of the hydraulically actuated equipment mechanically connected to said pneumatic cylinder and having an air space therein which varies in volume in response to the amount of hydraulic fluid contained in the reservoir means, discharge conduit means providing direct and continuous open fluid communication between said air outlet valve means and said reservoir means and acting solely to pass air compressed by movement of said piston rod to said air space for maintaining a predetermined level of pressurization thereof during movement of the hydraulically activated equipment, and pressure relief means in fluid communication with said air outlet valve means and said discharge conduit means to control the pressurization of air delivered to said reservoir means, said pressure relief means comprising a pressure relief valve having an outlet in fluid communication with said air inlet valve means to bypass compressed air thereto when the compressed air passed from said air outlet valve means through said discharge conduit means to said air space increases the pressurization of the air space above a predetermined level.

2. The apparatus of claim 1 wherein said pneumatic cylinder is double acting to compress air on both strokes of reciprocal movement of said cylinder piston rod.

3. The apparatus of claim 1 wherein said air inlet valve means comprises a one-way inlet valve at each end of said pneumatic cylinder to mutually exclusively pass air into said chamber upon reciprocal movement of said cylinder piston rod.

4. The apparatus of claim 3 wherein said air outlet valve means comprises a one-way outlet valve at each end of said pneumatic cylinder to mutually exclusively pass compressed air from said chamber to said discharge conduit means upon reciprocal movement of said cylinder piston rod.

* * * * *